US008118949B2

(12) United States Patent
Sachdev et al.

(10) Patent No.: US 8,118,949 B2
(45) Date of Patent: Feb. 21, 2012

(54) COPPER PRECIPITATE CARBURIZED STEELS AND RELATED METHOD

(75) Inventors: Anil K. Sachdev, Rochester Hills, MI (US); Benjamin L. Tiemens, Chicago, IL (US); Gregory B. Olson, Riverwoods, IL (US)

(73) Assignees: GM Global Technology Operations LLC, Detroit, MI (US); Northwestern University, Evanston, IL (US)

( * ) Notice: Subject to any disclaimer, the term of this patent is extended or adjusted under 35 U.S.C. 154(b) by 566 days.

(21) Appl. No.: 11/678,066

(22) Filed: Feb. 23, 2007

(65) Prior Publication Data

US 2007/0199625 A1 Aug. 30, 2007

Related U.S. Application Data

(60) Provisional application No. 60/776,593, filed on Feb. 24, 2006.

(51) Int. Cl.
*C23C 8/22* (2006.01)
*C22C 38/16* (2006.01)

(52) U.S. Cl. ..... 148/233; 148/318; 420/89

(58) Field of Classification Search ..... 148/332, 148/233, 318; 420/89
See application file for complete search history.

(56) References Cited

U.S. PATENT DOCUMENTS 4,410,374 A * 10/1983 Urabe ..... 148/233
5,876,521 A * 3/1999 Koo et al. ..... 148/328
6,162,389 A * 12/2000 Hase et al. ..... 420/92

OTHER PUBLICATIONS

ASM International, Materials Park, Ohio, Heat Treating: "Surface Hardening of Steel", vol. 4, pp. 312-314, Aug. 1991.*

* cited by examiner

*Primary Examiner* — Jessee R. Roe
(74) *Attorney, Agent, or Firm* — Dierker & Associates, P.C.

(57) ABSTRACT

A carburized and tempered hardened steel structure includes an iron based steel alloy including from about 3.7 to about 6 wt % copper, from 6 to about 10 wt % cobalt and from about 1 to about 10 wt % of non-ferrous secondary carbide formation elements selected from any of the group consisting of chromium, molybdenum, vanadium and combinations thereof. At least a percentage of the secondary carbide formation elements are in the form of metal carbides attached to nucleation sites on copper precipitates within a carburized portion of the structure, and wherein the copper precipitates are at least one of i) characterized by a mean copper precipitate radius of from about 0.1 nm to about 5 nm, or ii) characterized by a density of about $2.7\times10^{18}$ per cubic centimeter.

5 Claims, 4 Drawing Sheets

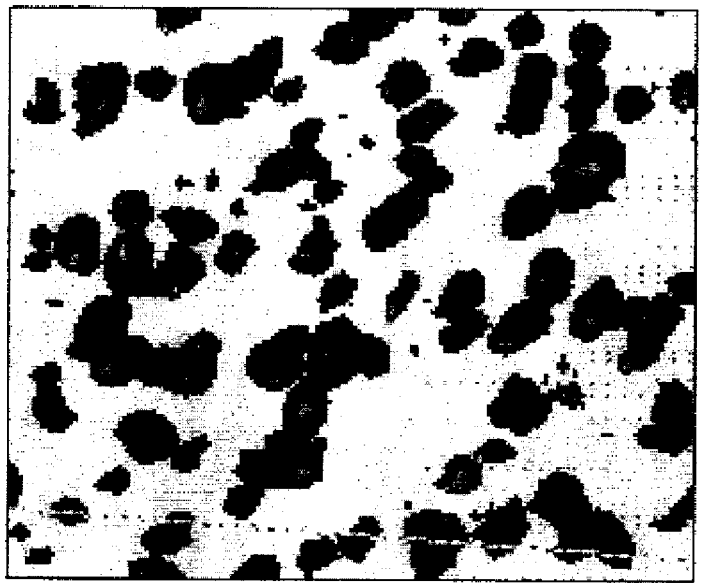
Cu PRECIPITATION
*FIG. —1—*
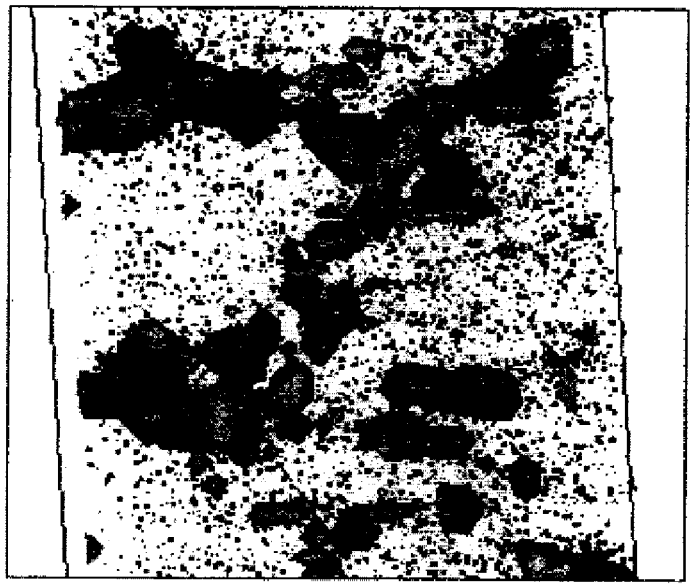
$M_2C$ PRECIPITATION
*FIG. —2—*

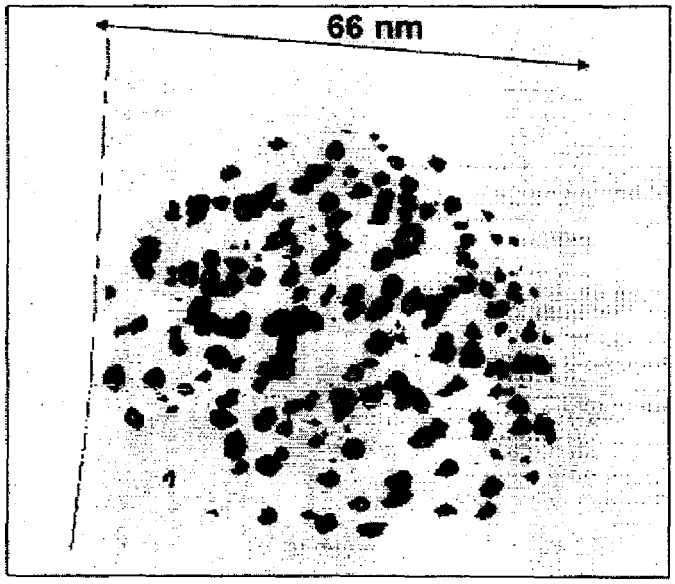
ALLOY D
*FIG. —3—*
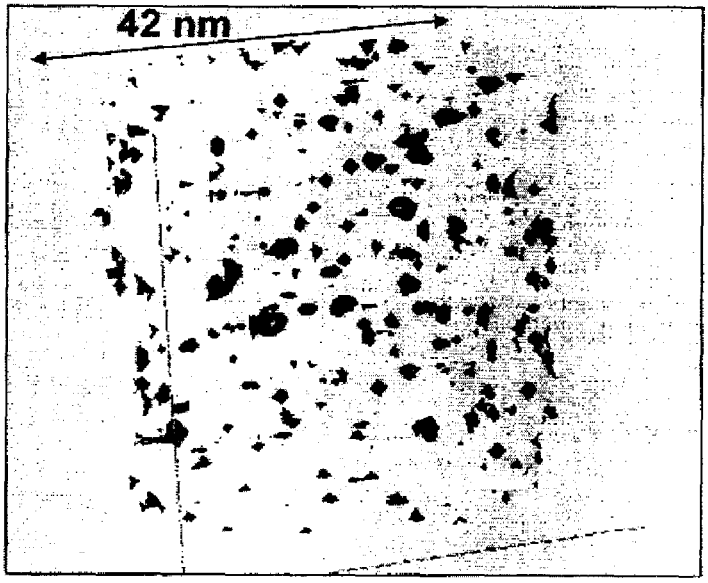
ALLOY B
*FIG. —4—*

(Mo,Cr,V)2C CARBIDE NUCLEATING ON Cu PRECIPITATE

COPPER PRECIPITATE CARBURIZED STEELS AND RELATED METHOD

CROSS-REFERENCE TO RELATED APPLICATIONS

This application claims the benefit of and priority from provisional application 60/776,593 filed Feb. 24, 2006 the contents of which are incorporated by reference in their entirety as if fully set forth herein.

TECHNICAL FIELD

The present invention relates generally to the field of carburization hardening of ferrous alloy parts such as gears or the like and more particularly to the controlled addition of copper to establish nucleation sites for the secondary precipitation of metal carbides during tempering. The practice may facilitate the precipitation of strengthening carbides with the reduced or eliminated use of cobalt as a precipitant promoter.

BACKGROUND OF THE INVENTION

It is well known to harden steels by heat treatment at elevated temperatures under a carbon rich atmosphere followed by tempering at higher temperatures. During the heat treatment process iron carbide is formed at elevated concentrations. During tempering at still higher temperatures, the iron carbide dissolves and secondary metal carbides are formed. Such secondary metal carbides typically include carbides of molybdenum, chromium, vanadium and other alloy constituents in the steel. These secondary metal carbides provide enhanced hardness within the carburized zone of the steel part. In the past, the precipitation of secondary metal carbides has been promoted by the addition of cobalt to the steel. Specifically, the cobalt additions have resulted in the formation of nucleation sites to aid in the collection of the precipitating secondary metal carbides. While cobalt additions have been successful in promoting secondary carbide precipitation, the attendant cost of such additions has been burdensome.

In the past, copper has been added as a strengthening agent to steels such as HSLA alloys used in pipelines, ship hulls and the like where carbon contents must be kept at low levels generally below about 0.05 wt. %. It has been proposed that copper in these alloys has the further benefit of adding grain refinement and toughness. Copper has also been added in limited amounts to steels for corrosion resistance. It has also been found that copper acts as a heterogeneous nucleation site for other phases. Copper has also been added to medium carbon steels to counteract cyclic softening during fatigue.

SUMMARY OF THE INVENTION

The present invention provides advantages and/or alternatives over the prior art by providing a method of promoting the precipitation of secondary metal carbides in a carbon enriched zone of a carburized steel part with the reduced or eliminated use of cobalt.

According to one contemplated practice, copper is added to a steel alloy in combination with carbide forming non-ferrous metals for use in a part subjected to carburizing heat treatment tempering with the substantial reduction or elimination of cobalt. During tempering the copper establishes heterogeneous nucleation sites to catalyze precipitation of non-ferrous metal carbides on the copper particles and/or on dislocations formed due to increased temper/grain coarsening resistance.

BRIEF DESCRIPTION OF THE DRAWINGS

The following drawings which are incorporated in and which constitute a part of this specification illustrate exemplary practices in accordance with the present invention and, together with the general description above and the detailed description set forth below, serve to explain the principals of the invention wherein:

FIG. 1 illustrates copper precipitation for a representative ferrous alloy composition at about 12 hours tempering time;

FIG. 2 illustrates secondary metal carbide precipitation on the copper precipitates in the ferrous alloy composition of FIG. 1 at extended tempering times of about 48 hours;

FIG. 3 illustrates primary copper precipitate character at about 12 hours tempering time for a representative alloy including about 3.7% copper;

FIG. 4 is an illustration similar to FIG. 3, showing primary copper precipitate character at about 12 hours tempering time for a representative alloy including about 1% copper;

Figure 5:
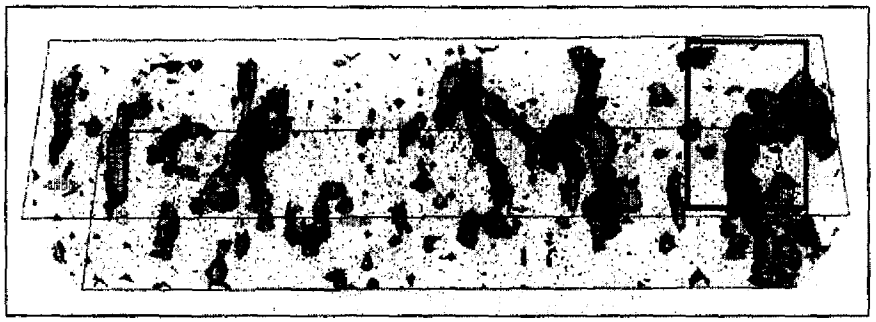
FIG. 5 illustrates a treated specimen of the alloy having about 3.7% copper at about 48 hours tempering having both copper and carbide precipitates.

While embodiments of the invention have been illustrated and generally described above and will hereinafter be described in connection with certain potentially preferred procedures and practices, it is to be understood and appreciated that in no event is the invention to be limited to such embodiments and procedures as may be illustrated and described herein. On the contrary, it is intended that the present invention shall extend to all alternatives and modifications as may embrace the broad principals of the invention within the true spirit and scope thereof.

DETAILED DESCRIPTION

Reference will now be made to the various figures. As previously indicated, in the practice of the instant invention copper is added to a steel alloy in combination with carbide forming non-ferrous metals for use in a part subjected to carburizing heat treatment and tempering with the substantial reduction or elimination of cobalt. It has been observed that during tempering the copper establishes heterogeneous nucleation sites to catalyze precipitation of non-ferrous metal carbides on the copper particles and/or on dislocations formed due to increased temper and grain coarsening resistance. Accordingly, the level of cobalt addition necessary to achieve a given hardness may be greatly reduced.

In order to evaluate the contemplated practice, a set of four representative alloys was identified with various combinations of high and low weight percentages of copper and 0.0 or 6 weight percent cobalt. The actual alloy compositions are set forth in Table 1 below.

TABLE 1

| Alloy | Ni (wt %) | Cr (wt. %) | Mo (wt %) | V (wt. %) | Cu (wt %) | Co (wt %) | Fe (wt %) |
|---|---|---|---|---|---|---|---|
| A | 3.3 | 2.6 | 3.13 | 0.2 | 1.05 | 0 | Balance |
| B | 5.5 | 2.6 | 3.32 | 0.1 | 1.05 | 6 | Balance |
| C | 3.7 | 1.6 | 3.48 | 0.15 | 3.7 | 0 | Balance |
| D | 5.5 | 2.5 | 1.72 | 0.1 | 3.7 | 6 | Balance |

FIG. 1 illustrates copper precipitation for a representative ferrous alloy composition D from Table 1 at about 12 hours tempering time. As will be observed, during initial stages of tempering the copper undergoes a primary precipitation thereby establishing a multiplicity of nucleation sites within the ferrous alloy. FIG. 2 illustrates secondary metal carbide precipitation in the ferrous alloy composition of FIG. 1 at extended tempering times of about 48 hours. As seen, the secondary metal carbides form at the copper precipitate nucleation sites. Thus, the general mechanism of primary copper precipitation followed by secondary metal carbide precipitation at the copper sites is established.

FIGS. 3 and 4 demonstrate the relative effect of copper concentration on the formation of nucleation sites for secondary carbide formation. In particular, FIG. 3 illustrates the character of copper precipitate formation in alloy "D" from Table 1 above after tempering for 1-12 hours at 482 degrees C. FIG. 4 illustrates the character of copper precipitate formation in alloy "B" with the same tempering history. As can be seen, at the higher percentage of copper corresponding to Alloy "D" both the mean precipitate radius and the number density of the precipitate increased relative to a lower percentage of copper corresponding to Alloy "B". Specifically, alloy "D" (3.7% Cu) showed a mean copper precipitate radius of about 1.4±0.4 nm with a number density of about 2.7×1018 per cubic centimeter while alloy "B" (1.05% Cu) showed a mean copper precipitate radius of about 0.9±0.2 nm with a number density of about 1.9×1018 per cubic centimeter. There was fully coherent copper precipitate in BCC iron and the copper displayed heterogeneous nucleation. While such copper precipitate radius dimensions and density levels have been observed to provide good nucleation for secondary carbide formation, it is likewise contemplated that other radius dimensions and corresponding number densities including smaller dimensions and larger dimensions in the range of about 0.1 nm to about 5 nm may likewise be obtained and be useful.

Figure 6:
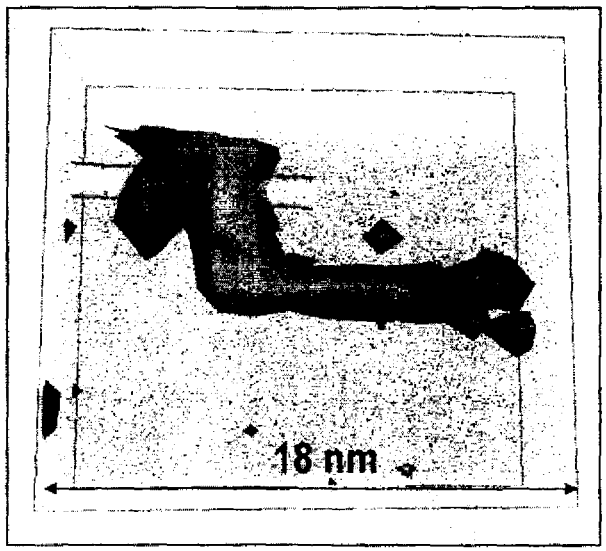
FIG. 6 illustrates a representative portion of the treated specimen of FIG. 5 showing secondary carbide nucleation on the copper precipitate.

As indicated previously, it has been found that at extended tempering the copper precipitate acts as nucleation sites for secondary metal carbide precipitation. By way of example only and not limitation, carbides of vanadium, molybdenum and chromium may tend to form at the regions of copper precipitation. This results in case hardening of the alloy. The formation of non-ferrous carbides at the copper precipitate sites is illustrated in FIGS. 5 and 6. In particular, FIG. 5 illustrates a treated specimen of alloy "D" having about 3.7% copper at about 48 hours tempering. FIG. 6 illustrates a representative portion of the treated specimen of FIG. 5 showing secondary carbide nucleation on copper precipitate after tempering for approximately 48 hours at 482 degrees C. Analysis showed that carbides of molybdenum, chromium and vanadium had nucleated on the copper precipitate. By way of example only, in FIG. 6, the large elbow shaped mass was a combination of Mo, Cr and V carbides extending between copper precipitate sites at either end.

Figure 7:
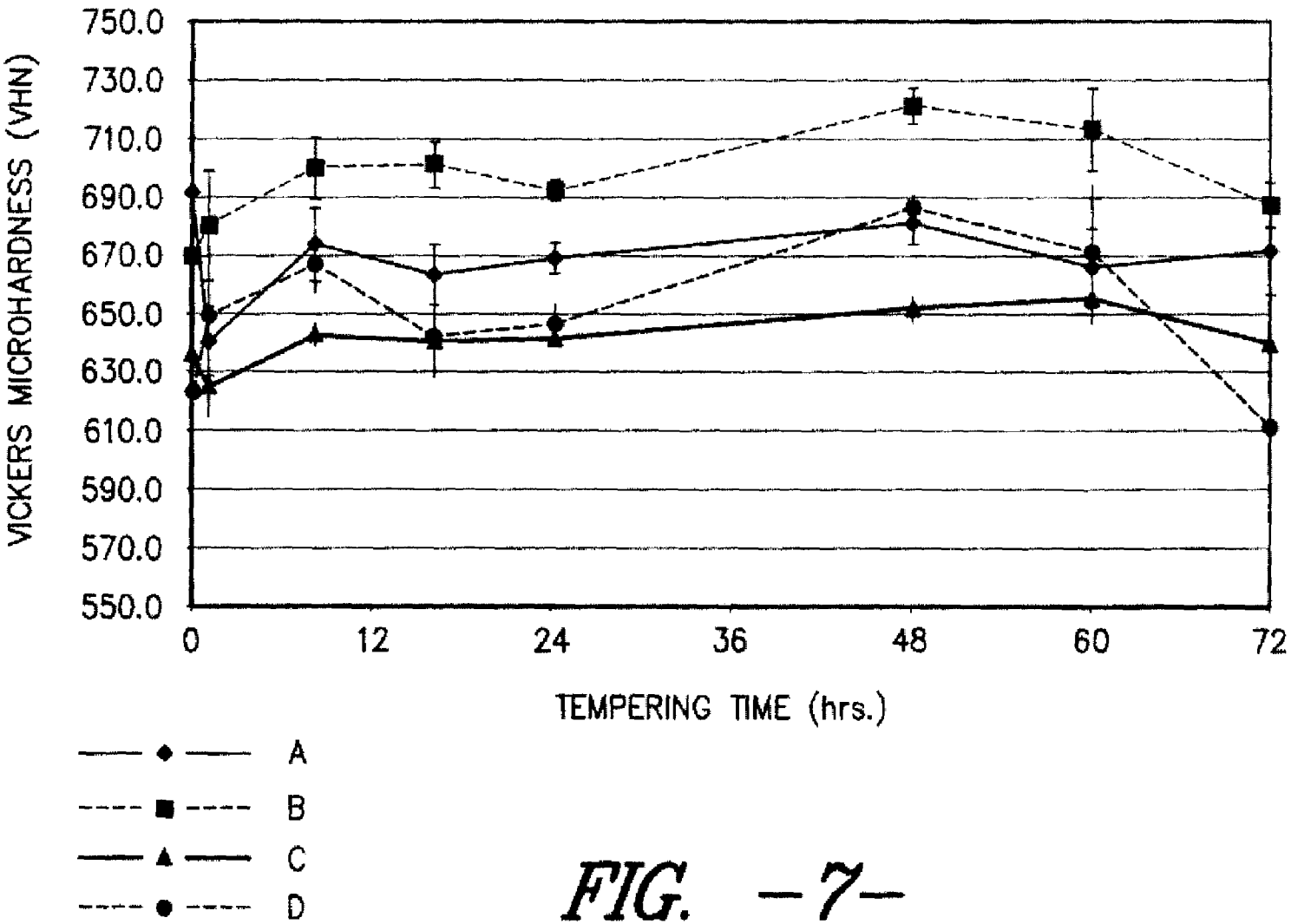
FIG. 7 is a graph illustrating the carburized tempering response of parts formed from each of the alloy compositions listed in Table 1.

FIG. 7 illustrates the carburized tempering response of parts formed from each of the alloy compositions listed in Table 1. As can be seen, alloys "A" and "C" with no cobalt addition nonetheless exhibited good hardness due to secondary carbide precipitation. A combination of copper and cobalt was found to provide substantially increased hardness levels even at relatively low levels of cobalt addition.

In light of the above, it has been found that the addition of controlled amounts of copper may permit a substantial reduction or elimination of cobalt while still achieving desired hardness levels in hardened steel alloys. Specifically, it is contemplated that copper levels of about 0.1 to about 6 wt % in combination with cobalt additions of 0 to about 10 wt % may provide desirable hardening character when used in steel alloys containing about at least 1 wt % to about 10 wt % of secondary carbide formation elements including but not limited to any of chromium, molybdenum, vanadium and combinations thereof.

It is to be understood that while the present invention has been illustrated and described in relation to potentially preferred embodiments, constructions, and procedures, that such embodiments, constructions, and procedures are illustrative only and that the invention is in no event to be limited thereto. Rather, it is contemplated that modifications and variations embodying the principals of the invention will no doubt occur to those of skill in the art. It is therefore contemplated and intended that the present invention shall extend to all such modifications and variations as may incorporate the broad aspects of the invention within the true spirit and scope thereof.

What is claimed is:

1. A carburized and tempered hardened steel structure comprising an iron based steel alloy comprising from about 3.7 to about 6 wt % copper, from 6 to about 10 wt % cobalt and from about 1 to about 10 wt % of non-ferrous secondary carbide formation elements selected from any of the group consisting of chromium, molybdenum, vanadium and combinations thereof, wherein at least a percentage of the secondary carbide formation elements are in the form of metal carbides attached to nucleation sites on copper precipitates within a carburized portion of the structure, and wherein the copper precipitates are at least one of i) characterized by a mean copper precipitate radius of from about 0.1 nm to about 5 nm, or ii) characterized by a density of about $2.7\times10^{18}$ per cubic centimeter.

2. The carburized and tempered hardened steel structure as recited in claim 1, wherein the copper precipitates are characterized by a mean copper precipitate radius of from about 0.9 nm to about 5 nm.

3. The carburized and tempered hardened steel structure as recited in claim 1, wherein the copper precipitates are characterized by a mean copper precipitate radius of from about 1.4 nm to about 5 nm.

4. A method of case hardening a steel structure, the method comprising the steps of:

(a) applying carburizing treatment to an iron based steel alloy comprising from about 3.7 wt % to about 6 wt % copper, from 6 to about 10 wt % cobalt and from about 1 wt % to about 10 wt % of non-ferrous secondary carbide formation elements selected from any of the group consisting of chromium, molybdenum, vanadium and combinations thereof;

(b) tempering the steel alloy following the carburizing treatment at an effective tempering time and temperature such that at least a percentage of the copper precipitates from solution with the iron and at least a portion of the secondary carbide formation elements form metal carbides attached to nucleation sites on the copper precipitate locations within a carburized portion of the structure;

wherein the copper precipitates are at least one of i) characterized by a mean copper precipitate radius of from about 0.1 nm to about 5 nm, or ii) characterized by a density of about $2.7\times10^{18}$ per cubic centimeter.

5. The method as recited in claim 4, wherein the copper precipitates are characterized by a mean copper precipitate radius of from about 0.9 nm to about 5 nm.

* * * * *